US009526328B2

(12) United States Patent
Illulian

(10) Patent No.: US 9,526,328 B2
(45) Date of Patent: Dec. 27, 2016

(54) FOLDING FURNITURE WITH LEGS

(71) Applicant: Khosro David Illulian, Los Angeles, CA (US)

(72) Inventor: Khosro David Illulian, Los Angeles, CA (US)

( * ) Notice: Subject to any disclaimer, the term of this patent is extended or adjusted under 35 U.S.C. 154(b) by 0 days.

(21) Appl. No.: 14/907,474

(22) PCT Filed: Feb. 24, 2015

(86) PCT No.: PCT/US2015/017294
§ 371 (c)(1),
(2) Date: Jan. 25, 2016

(87) PCT Pub. No.: WO2015/130671
PCT Pub. Date: Sep. 3, 2015

(65) Prior Publication Data

US 2016/0206088 A1 Jul. 21, 2016

Related U.S. Application Data

(60) Provisional application No. 61/946,603, filed on Feb. 28, 2014, provisional application No. 61/947,255,
(Continued)

(51) Int. Cl.

| | |
|---|---|
| ***A47C 19/00*** | (2006.01) |
| ***A47B 3/083*** | (2006.01) |
| ***A47B 3/06*** | (2006.01) |
| ***A47B 3/087*** | (2006.01) |
| ***A47B 13/02*** | (2006.01) |

(Continued)

(52) U.S. Cl.
CPC ..... *A47B 3/083* (2013.01); *A47B 3/06* (2013.01); *A47B 3/087* (2013.01); *A47B 3/0818* (2013.01); *A47B 13/021* (2013.01); *A47B 13/08* (2013.01); *A47C 19/005* (2013.01); *A47C 19/022* (2013.01); *A47C 19/024* (2013.01)

(58) Field of Classification Search
CPC ..... A47B 3/083; A47B 3/0818; A47B 13/08; A47C 19/022; A47C 19/024; A47C 19/005
USPC ..... 108/115–135, 167–170, 172, 153.1, 155,108/158; 5/193, 53.1, 53.2, 55.3, 201, 296, 5/176.1, 179, 311, 301
See application file for complete search history.

(56) References Cited

U.S. PATENT DOCUMENTS

| | | | | |
|---|---|---|---|---|
| 1,747,691 | A | 8/1930 | Bellows | |
| 1,948,724 | A * | 2/1934 | Laun | A47B 3/12 108/156 |

(Continued)

OTHER PUBLICATIONS

International Search Report and Written Opinion for corresponding PCT/US2015/017294, dated May 28, 2015.

*Primary Examiner* — Daniel J Troy
*Assistant Examiner* — Timothy M Ayres
(74) *Attorney, Agent, or Firm* — Notaro, Michalos & Zaccaria P.C.

(57) ABSTRACT

A folding furniture piece has a planar member with first and second parts with outer perimeters and adjacent straight sides hinged to each other. A plurality of support beams extend on inner surfaces of the parts and at least along the outer perimeters and inner straight sides of each part. Each side beam has at least one locking bore and the locking bores are coaxial when the planar member is in the use condition to receive a locking pin to lock the use condition in place. A plurality of legs are movably connected to the planar member for supporting the planar member above a floor in the use condition.

8 Claims, 10 Drawing Sheets

Related U.S. Application Data filed on Mar. 3, 2014, provisional application No. 61/947,299, filed on Mar. 3, 2014.

(51) Int. Cl.

| | |
|---|---|
| ***A47C 19/02*** | (2006.01) |
| ***A47B 3/08*** | (2006.01) |
| ***A47B 13/08*** | (2006.01) |

(56) References Cited

U.S. PATENT DOCUMENTS

| | | | | | |
|---|---|---|---|---|---|
| 2,099,450 | A * | 11/1937 | Meyer | F16B 12/48 | 108/158 |
| 2,326,461 | A | 8/1943 | Howe | | |
| 2,342,591 | A | 2/1944 | McLean | | |
| 2,669,977 | A * | 2/1954 | Lewis | F22G 5/12 | 122/479.1 |
| 2,681,841 | A * | 6/1954 | Sperry | A47B 3/083 | 108/129 |
| 2,699,977 | A * | 1/1955 | Breslow | A47B 3/083 | 108/35 |
| 4,064,812 | A * | 12/1977 | Commanda | A47B 3/083 | 108/132 |
| 4,841,877 | A * | 6/1989 | Virtue | A47B 3/0912 | 108/167 |
| 6,016,756 | A * | 1/2000 | McMahon | A47B 13/021 | 108/156 |
| 7,707,949 | B2 * | 5/2010 | Larcom | 108/132 | |
| 8,850,638 | B1 * | 10/2014 | Suh | A47C 19/12 | 5/176.1 |
| 2008/0092289 | A1 | 4/2008 | Smith et al. | | |
| 2011/0219992 | A1 | 9/2011 | Galloro | | |
| 2013/0228296 | A1 | 9/2013 | Smith et al. | | |

* cited by examiner

FOLDING FURNITURE WITH LEGS

CROSS REFERENCE TO RELATED APPLICATIONS

This application claims priority on the applicant's provisional patent application Nos. 61/946,603 filed Feb. 28, 2014 for a Foldable Headboard, 61/947,255 filed Mar. 3, 2014 for a Foldable Table With Concealed Legs, and 61/947,299 filed Mar. 3, 2014 for a Foldable Table With Screw Legs, which are all incorporated herein by reference.

FIELD AND BACKGROUND OF THE INVENTION

The present invention relates generally to the field of furniture, and, in particular, to a new and useful piece of folding furniture having a compact folded condition for storage or shipping, and a use condition for use, with legs that can be deployed into or attached for an extended position in the use condition of the furniture piece, and no tools needed to transition between the compact folded and the deployed use conditions.

The size of items to be shipped greatly effects the cost for such shipping, with larger, awkward items costing far more than small, well bounded items. The headboards of beds are a good example. While not overly heavy, such items are wide and tall, especially if they include integral legs for attaching to bedframes, and this awkward size increases shipping costs.

Folding tables of various types are known but, as with headboards, there is a need for improvements to facility shipping and use of such bulky awkward furniture items, preferably without the need for tools.

SUMMARY OF THE INVENTION

It is an object of the present invention to provide a folding furniture piece comprising a planar member having a first part with an outer perimeter and an inner straight side, and a second part with an outer perimeter and an inner straight side. The inner straight sides are adjacent each other and are hingedly connected to each other, the planar member having a folded compact condition for shipping and storage with inner surfaces of the first and second parts overlapping each other, and an unfolded use condition with outer surfaces of the first and second parts lying in a common plane. A plurality of support beams extend on the inner surfaces of the first and second parts, along the outer perimeters and inner straight sides of each part at least, the support beams defining spaces with the inner surfaces of the first and second parts where additional parts of the furniture such a as legs, or coverings for the furniture can be stored in the folded condition. Each of the support beams along the inner straight sides of the first and second parts have at least one, but preferably at least two pairs of locking bores extending substantially transversely to a respective straight side, the locking bores being coaxially aligned with each other when the planar member is in the use condition. A locking pin is removably extended into each aligned set of locking bores when the planar member is in the use condition, for locking the planar member flat, in the use condition. A plurality of legs are movably connected to the planar member for supporting the planar member above a floor in the use condition.

The folding furniture piece may be a table or bed headboard, or other furniture type that benefits from being folded and which has legs.

When embodied as a folding table, the table top can have four or more sides, be square, rectangular, round or oval and of any height, including but not limited to a coffee table, dining table, counter height table, bar height table, side table with or without apron, or any other type of table. Its top is folded evenly in half with hinges and legs that fold inwards into the body of the folded tabletop. The legs can be of any practical length for supporting the planar member above the floor to any desired height in the use condition. In this embodiment the legs are hinged to the first and second parts, and can be securely locked in place when opened. Product materials can be, but are not limited to wood, resin, laminate, MDF, fiberglass and/or other construction materials suitably strong and solid to be formed into furniture.

Another folding table embodiment that may also have a table top of any shape and size, and, as determined by the lengths of the legs, any height as the folding table with folding legs, and which folds evenly in half and may be made of the same wide variety of materials, has legs of any selected shapes, sizes and heights and of the same or different material as the table top. The legs are attached to the bottom surface of the table top by having threaded posts or pins, preferably of metal, that are screwed into threaded preferably metal sockets in the bottom surface of the table. Once the leg posts or pins are secured into place, the table can be placed upright onto its now attached legs for use.

Another embodiment of the invention is a foldable headboard of any desired shape and size that folds in half and/or quarters with legs attached that fold into the body of the folded headboard or that can be connect to a lower edge of the headboard in its use condition. This foldable headboard is designed in such a manner with pins, not requiring any tools, that securely lock in place and prevent the headboard from inadvertently folding.

As with the table embodiments, product materials can be, but are not limited to wood, resin, laminate, MDF, fiberglass and other construction materials. The headboard can be made with our without padding and can advantageously be sold with one or more, fitted fabric slipcovers to give the headboard in its use condition, a wide variety of appearances. The internal space of the folded headboard can be use to store the legs, the locking pins and other items and accessories such as one or more decorative slipcovers of cloth or other flexible material for the headboard in use.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 1:
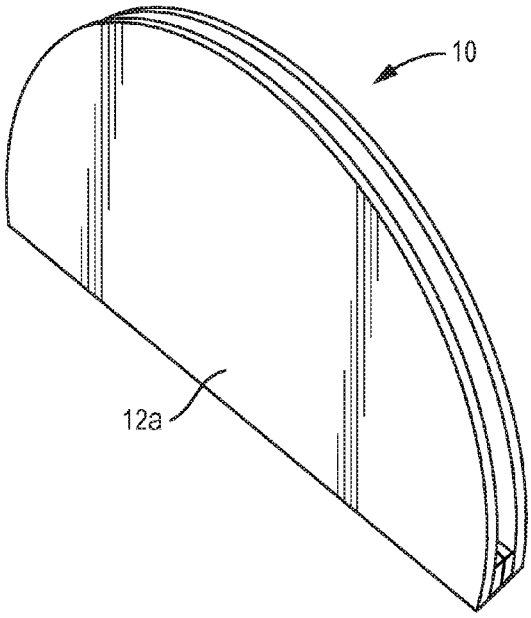
FIG. 1 is a perspective view of a furniture piece according to one embodiment of the invention, in the form of a foldable round or oval table with four hinged legs stored within an inner volume of the furniture in its folded condition.
Figure 2:
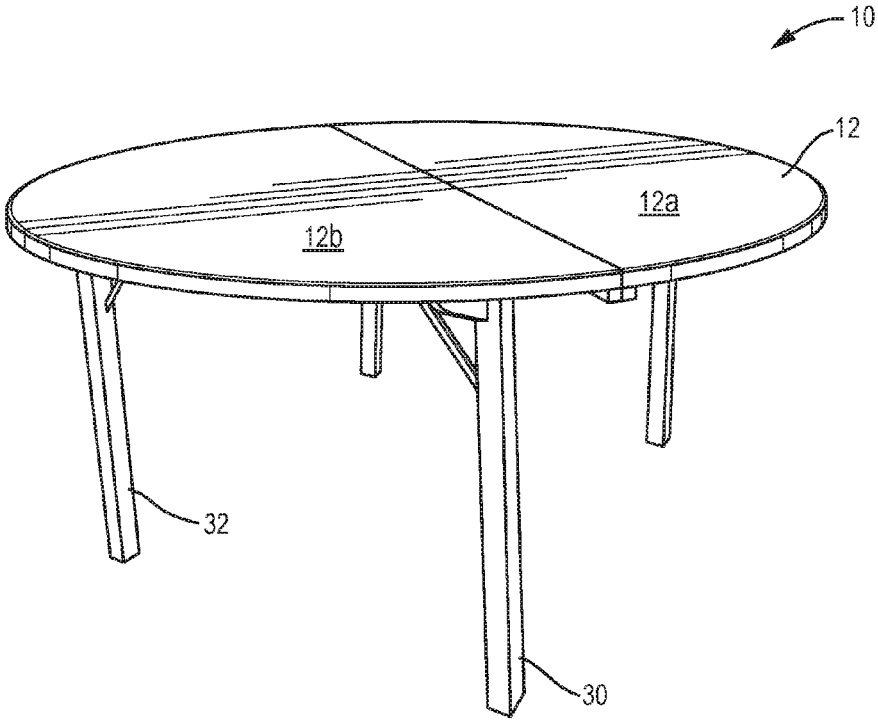
FIG. 2 is a perspective view of the furniture piece of FIG. 1, in its unfolded use condition as a table with table top ready for use.
Figure 3:
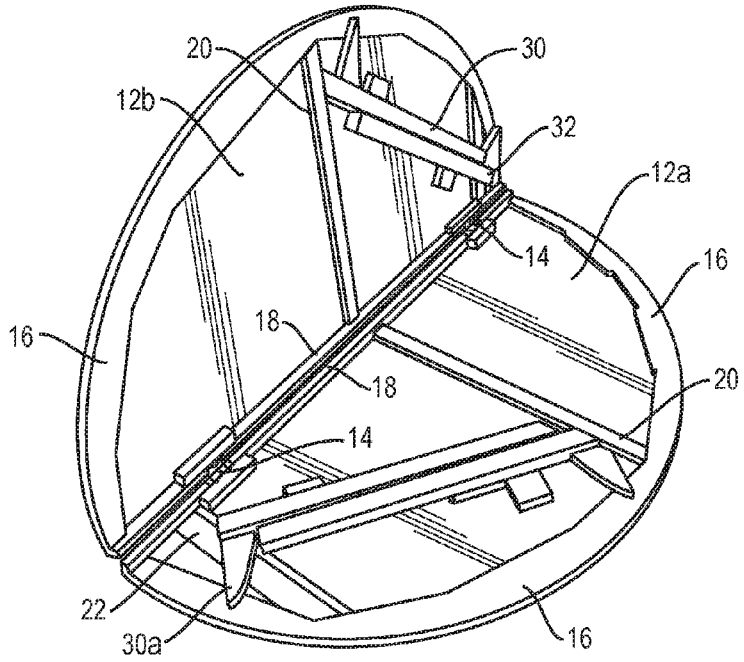
FIG. 3 is a perspective view of the furniture piece of FIG. 1, partly unfolded to show its internal structure and its four folded legs.
Figure 4:
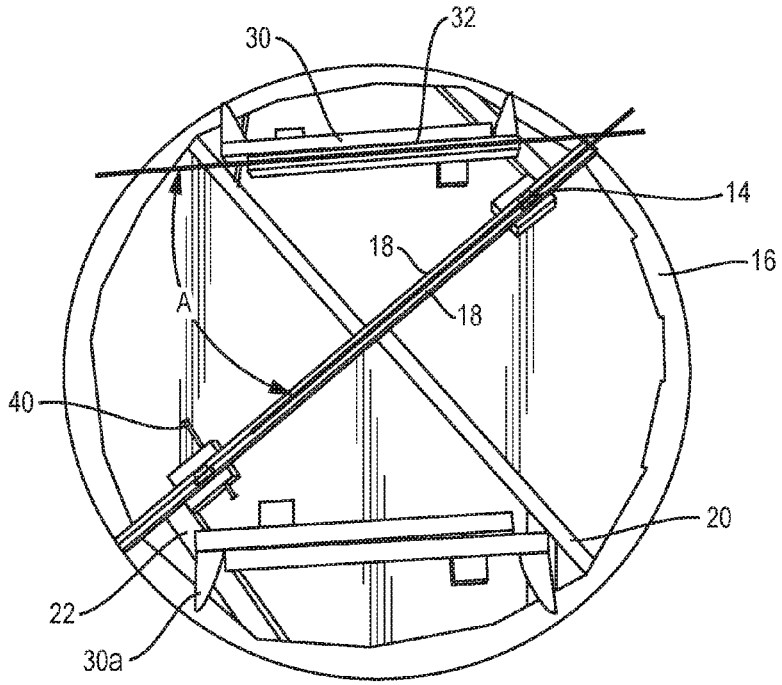
FIG. 4 is a bottom plan view of the furniture piece of FIG. 1 with its planar member flat and locking pins partly in place to keep its table top flat for use and its hinged legs still in the folded condition.

Referring now to the drawings, in which like reference numerals are used to refer to the same or similar elements, FIGS. 1 and 2 show a folding furniture piece in the form of a folded table 10 that is round or oval but that can be of any shape. It includes a planar member 12 having a first part 12*a* with an outer perimeter and an inner straight side, and a second part 12*b* with an outer perimeter and an inner straight side. As shown in FIGS. 3 and 4, the inner straight sides are adjacent each other and are hingedly connected to each other by two or more metal hinges 14. The two pivotally connected parts of each hinge 14 is fixed to a respective support beam 18 by screws or other suitable means. The planar member 12 has a folded compact condition shown in FIG. 1 for shipping and storage with inner surfaces of the first and second parts overlapping each other, and an unfolded use condition shown in FIG. 2, with outer surfaces of the first and second parts lying flat in a common plane to form a table top.

A plurality of support beams 16 extend on the inner surfaces of the first and second parts 12*a* and 12*b*, along the outer perimeters. The support beams 18 extend along the inner straight sides of each part, and additional intermediate support beams 20 and 22 extend between the perimeter and the inner straight sides. The support beams together strengthen the parts 12*a* and 12*b* and define spaces with the inner surfaces of the first and second parts that define an interior storage volume when the furniture is in its folded condition. Additional parts of the furniture such as the legs, table cloths or coverings or other accessories for the furniture can be stored within this volume. All beams are fixed to the bottom surface of the parts 12*a* and 12*b* by glue and/or screws, or by any other means known in the furniture art.

While the legs can be stored in this volume in some embodiments of the invention to be described in detail later in this disclosure, in the embodiment of FIGS. 1 to 7, the legs are hinged to the additional intermediate support beams 20 and 22 and reside in the volume between the first and second parts 12*a* and 12*b*, when these parts are in the folded condition.

Figure 5:
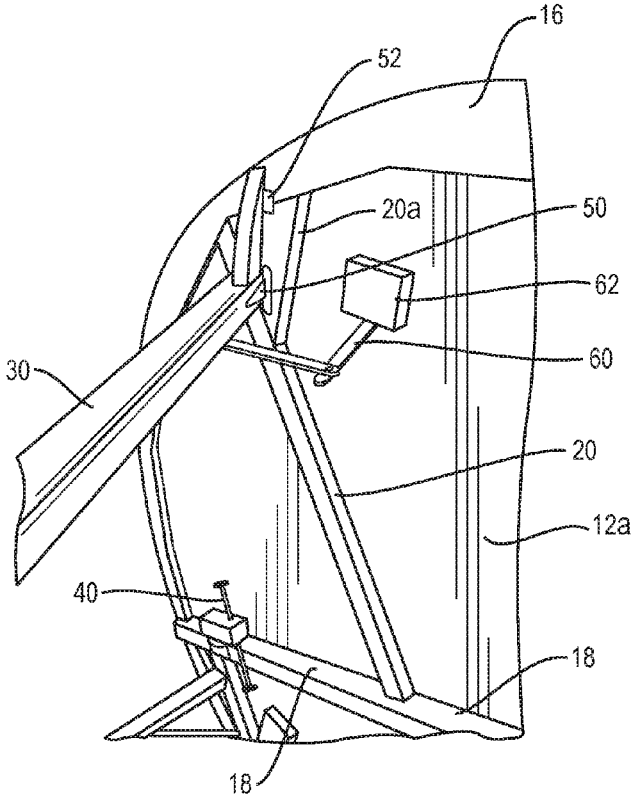
FIG. 5 is a partial perspective view of the bottom of the furniture piece of FIG. 1 taken near one of the legs as it is being unfolded into its locked, use position.
Figure 6:
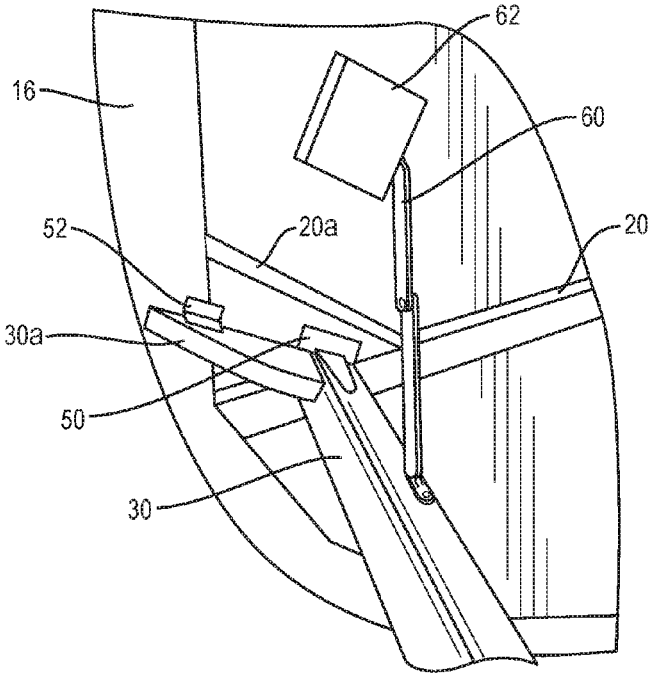
FIG. 6 is view similar to FIG. 5 with the leg in its locked, use position.

As best illustrated in FIGS. 4 to 6, four legs in two adjacent pairs 30, 32, each have upper ends that are pivotally connected by hinges to support beams under the parts 12*a* and 12*b* of the table 10. One leg 30, for example, is connected by a pair of hinges 50 and 52 to support beams 16 and 20, with hinge 50 being secured to a gusset plate 20*a* that extends at an acute angle between one of the outer perimeter support beams 16 and one of the intermediate support beams 20, under one of the parts. To strengthen each leg, each leg 30 has a leg gusset 30*a* fixed, e.g. by glue and screws, to an outside surface of the leg, the second leg hinge 52 being connected, preferably by screws, between this leg gusset and the perimeter support beam 16. The remaining legs have similar leg gussets and are connected by hinges in the same way to respective long or short support beams 20 or 22 and adjacent sections of the perimeter support beams 16.

In addition to hinges 50 and 52, each leg 30 and 32 is also connected by double-armed, locking, hinged brackets 60 of known design, between the same side of the leg that is connected to the hinges 50, 52, and a support block 62 fixed to the bottom surface of a respective part 12*a* or 21*b*. FIG.

5 shows an intermediate position of bracket 60 as the leg 30 is being pivoted from its storage position of FIG. 4 to its final locked position of FIG. 6. As shown in FIG. 6, the bracket 60 is locked with its two arms aligned to create a secure three point support for leg 30, along with the hinges 50 and 52 on the gussets 20*a* and 30*a*. To re-fold the legs, pressure is applied in a known fashion to the inside surface of the hinge of bracket 60 to return it to its position of FIG. 5, from where the leg can be further folded into its storage position, flat adjacent the bottom of its part 12*a* or 12*b*.

With all four legs 30 and 32 in their respective unfolded positions illustrated in FIG. 6, the planar member 12 of the table 10 is supported above the floor in the use condition as shown in FIG. 2.

Figure 7:
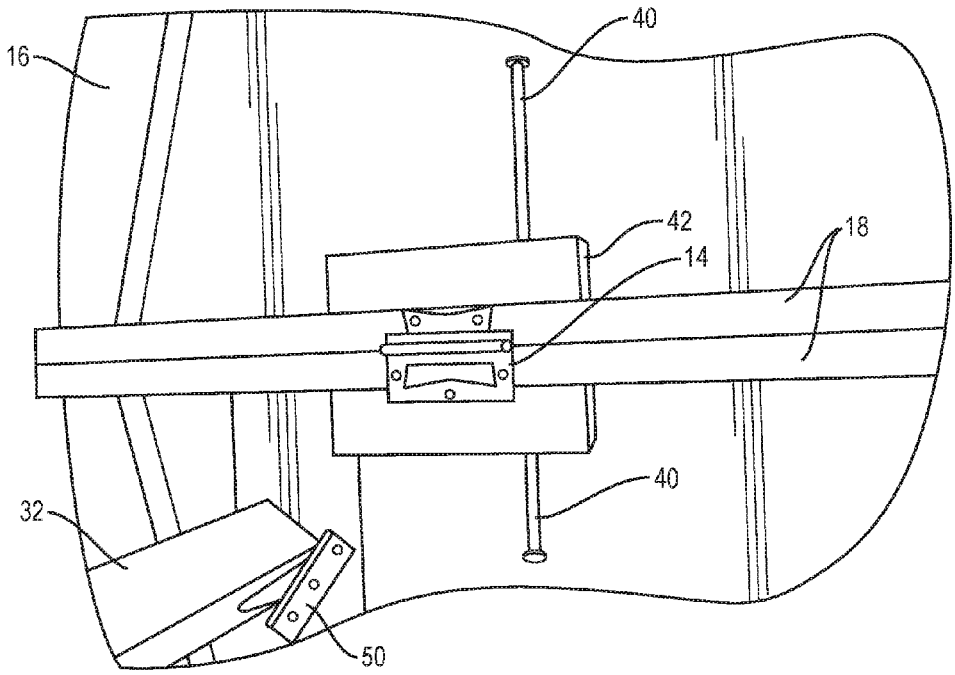
FIG. 7 is a partial perspective view of the bottom of the furniture piece of FIG. 1 taken near one side of the inner side edges to illustrate the locking pins and their use for holding the table top in its use condition.

With reference to FIGS. 4 and 7, a key feature of the invention that makes certain that the planar member 12 will not inadvertently fold between its inner side support beams 18, 18, for example, while moving the table, is that the inner support beams 18, 18 each have at least one, but preferably at least two pairs of locking bores extending substantially transversely to a respective straight side, the locking bores being coaxially aligned with each other when the planar member is flat as in FIG. 4.

A locking pin 40 is removably extended into each set of aligned locking bores when the planar member is in the flat or use condition, for locking the planar member flat, in the use condition. To further secure this anti-folding effect, pins 40 are strong metal, e.g. brass or steel, and extra pin-receiving blocks 42 are fixed, e.g. by glue and/or screws, to the sides of support beams 18, 18 and to the bottom surface of the adjacent part 12*a* or 12*b*. The locking bores for the locking pins 40 extend through these blocks as well. Each locking pin is long enough to extend the full length of each aligned set of locking bores, and importantly to fully span the junction between the beams 18 for positively preventing the planar member hinges 14, 14, from folding.

As illustrated in FIGS. 3 and 4, whether the folding table top is square, rectangular, round, oval and of any other shape, a straight line between the leg connectors on each part of the planar member 12*a* and 12*b*, form an acute angle A with the straight inner sides of the respective part. This places the folded legs 30 and 32 at this acute angle as well. This has been found to improve the strength of the table in its use condition and its compact shape and size in its folded condition.

The table top and legs of table 10 can be any type of table, e.g. a dining table, a counter height table, a bar height table and side table with or without apron or other type of table. Its top is folded evenly in half with hinges and legs that fold inwardly into the body of the folded tabletop. The legs can be of any practical length for supporting the planar member 12 above the floor to any desired height in the use condition. In this embodiment, the legs are hinged to the first and second parts and can be securely locked in place by the brackets 60 when opened. Product materials can be, but are not limited to wood, resin, laminate, MDF, fiberglass and/or other construction materials suitably strong and solid to be formed into furniture.

Another folding table embodiment 110 shown in FIGS. 8 to 12, has a table top 112 of any shape and size, and, as determined by the lengths of its legs, any height, folds evenly in half and may be made of the same wide variety of materials, has legs of any selected shapes, sizes and heights and of the same or different material as the table top as in the embodiment of FIGS. 1 to 7.

Four legs 130 and 132, are attached to the bottom surface of the table top 112 by having threaded posts 132*a*, preferably of metal, that are screwed into threaded, preferably metal sockets 150 that are fixed, e.g. by screws, to the bottom surface of the table top 112. Once the leg posts are secured into place in each respective socket 150, the table can be placed upright from its FIG. 9 position to its FIG. 11 position, onto its legs for use.

Figure 10:
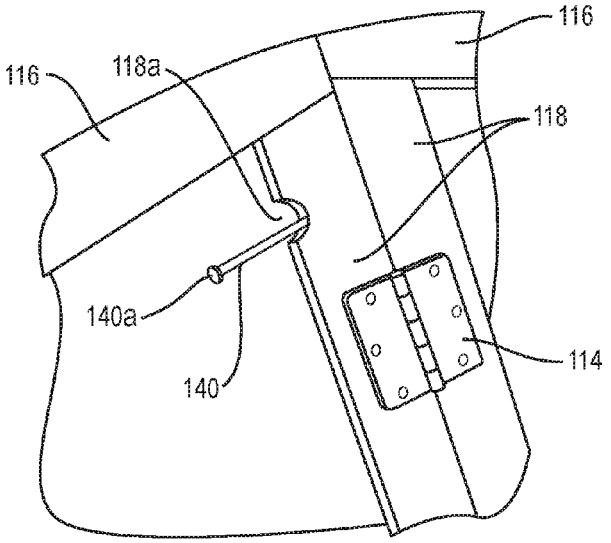
FIG. 10 is a partial perspective view of the bottom of the furniture piece of FIGS. 8 and 9 taken near one side of the inner side edges to illustrate the locking pins and their use for holding the table top in its use condition.

To keep the table top 112 from accidently folding, locking pins 140 best shown in FIG. 10, are seated in and extend though aligned locking bores extending through a pair of inner straight side support beams 118 fixed, e.g. by glue and/or screws to the bottom surface of two halves of the table top 112. To keep the pins 140 to a practical length, and to confine the enlarged head 140*a* of the pin in a somewhat enclosed area, notches 118*a* are cut into the inside long surface of one of the support beams 118 at the entrance end of the locking bore.

Figure 8:
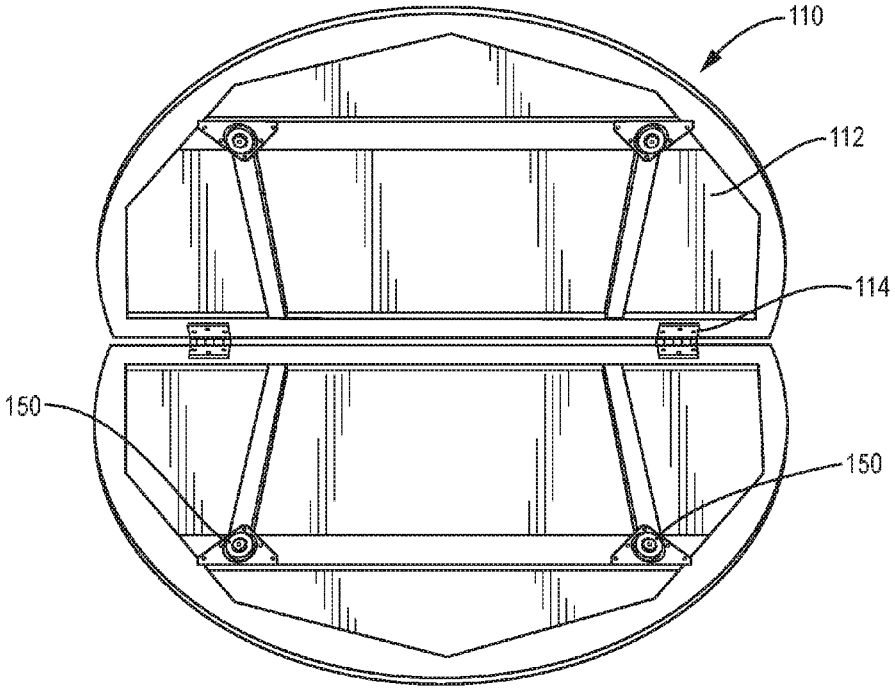
FIG. 8 is a view similar to FIG. 3 of a second embodiment of the invention in the form of a foldable round or oval table that uses legs which are threaded to sockets in the planar member.
Figure 9:
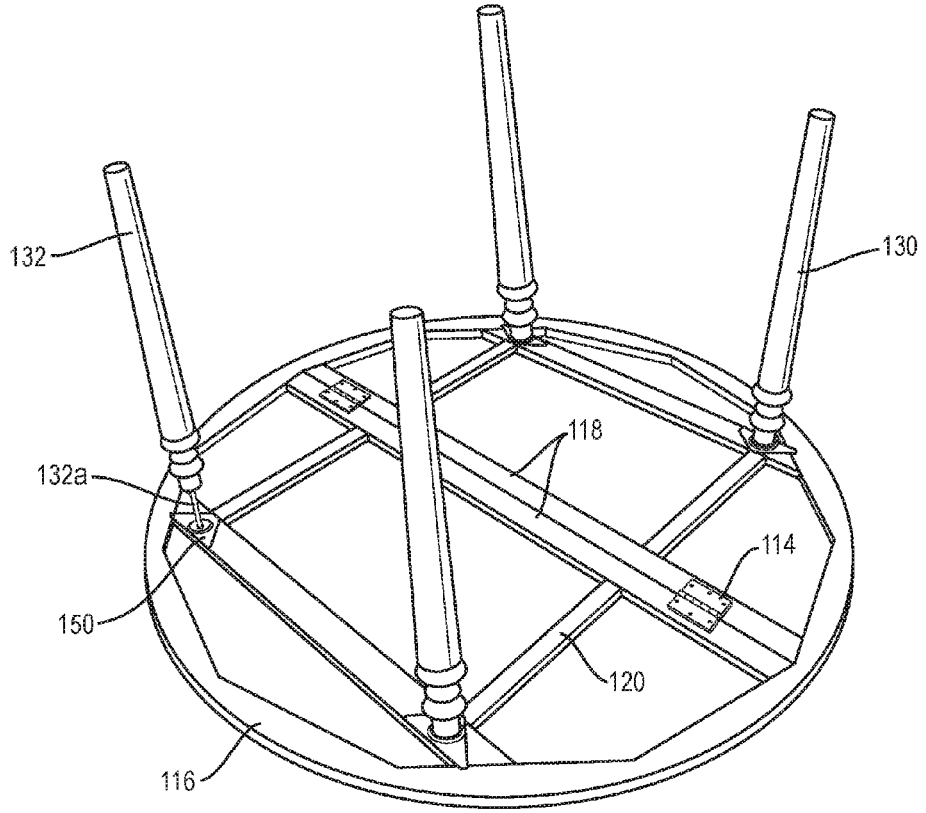
FIG. 9 is a perspective view of the bottom of the furniture piece of FIG. 8 with legs and locking pins in place, the table to be turned rig ht-side-up for use.

Like the embodiment of FIGS. 1 to 7, the table top 112 of FIGS. 8 to 12 have first and second parts with outer perimeters and inner straight sides. As shown in FIGS. 8 and 9, the inner straight sides are adjacent each other and are hingedly connected to each other by two or more metal hinges 114. The table top 112 has a folded compact condition for shipping and storage with inner surfaces of the first and second parts overlapping each other, and an unfolded use condition shown in FIGS. 9 and 11 with outer surfaces of the first and second parts lying flat in a common plane to form the table top.

A plurality of support beams 116 extend on the inner surfaces of the first and second parts along the outer perimeters. The inner side support beams 118 extend along the inner straight sides of each part, and additional intermediate support beams 120 extend between the perimeter and the inner straight sides. The support beams together defining spaces with the inner surfaces of the first and second parts that together define a storage volume when the furniture is in its folded condition, where additional parts of the furniture such as the legs, table cloths or coverings or other accessories for the furniture can be stored.

Figure 11:
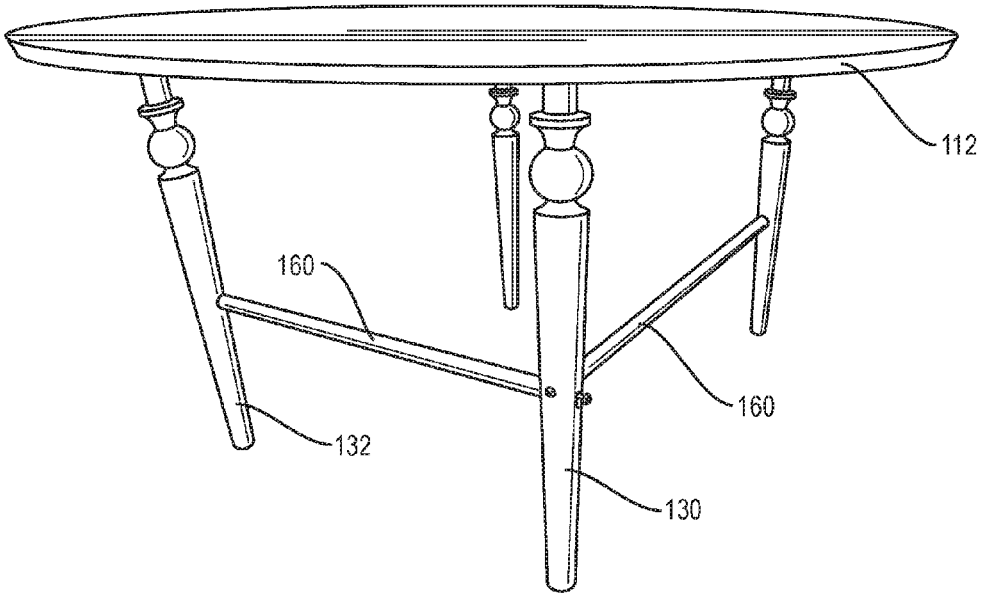
FIG. 11 is a perspective view of the furniture piece of FIG. 9 in an upright use condition and with the addition of cross beams connected between the legs to straighten the table for use.
Figure 12:
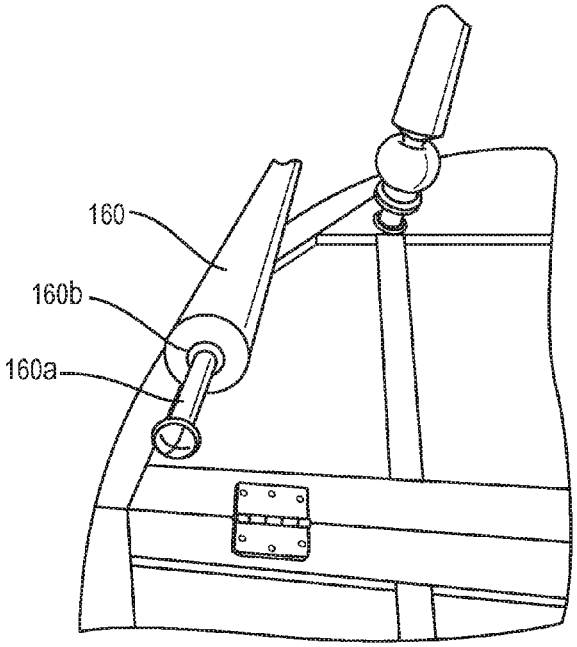
FIG. 12 is a perspective view of the end of one of the cross beams to illustrate an embodiment for connecting the supports to the table legs.
Figure 13:
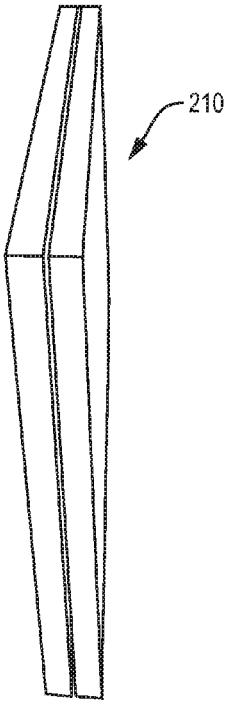
FIG. 13 is a perspective view of a furniture piece according to a third embodiment of the invention in the form of a foldable headboard for a bed with legs and room for other accessories like a slip cover, stored within an inner volume of the furniture in its folded condition.

As shown in FIGS. 11 and 12, to further strengthen the table, four cross beams 160 are fixed between each pair of legs 130 or 132, by long screws 160*a* extending through cross holes in the legs. Screws 160*a* are threaded into threaded metal fittings 160*b* in the end of each cross beam 160.

Another embodiment of the invention illustrated in FIGS. 13 to 18, is a foldable headboard 210 of any desired shape and size that folds in half and/or quarters with legs attached that fold into or store in the body of the folded headboard and can be connect to a lower edge of the headboard in its use condition.

This foldable headboard, as is the case with the folding tables, is designed so as not to require tools for assembly, but that still securely locks in place and prevents the headboard from inadvertently folding form its use condition. Product materials can be, but are not limited to wood, resin, laminate, MDF, fiberglass and other construction materials. The headboard can be made with our without padding and can advantageously be sold with one or more, fitted fabric slipcover to give the open headboard a wide variety of appearances. The internal space of the folded headboard can be use to store the legs and other items such as the decorative cloth or other flexible slipcover for the headboard in use.

Figure 14:
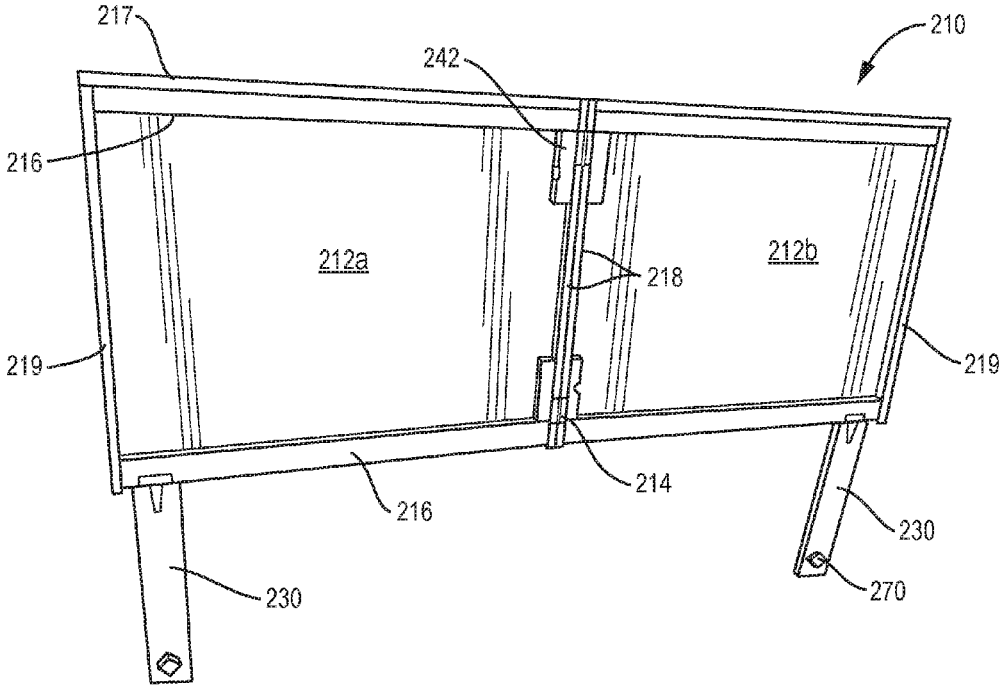
FIG. 14 is a rear elevational view of the furniture piece of FIG. 13 with its planar member flat and locking pins in place to keep it flat for use and its legs extended and ready to be attached to the head end of a bed frame.

Like the table embodiments, the headboard 210 has first and second parts 212*a* and 212*b* with outer perimeters and inner straight sides. As shown in FIG. 14, the inner straight sides are adjacent each other and are hingedly connected to each other by two or more metal hinges 214. The headboard 210 has a folded compact condition shown in FIG. 13, for shipping and storage with inner surfaces of the first and second parts overlapping each other, and an unfolded use condition shown in FIGS. 14 and 18 with outer surfaces of the first and second parts lying flat in a common plane to form the main flat body 212 of the headboard 210.

A plurality of support beams 216 extend on the inner surfaces of the first and second parts 212*a* and 212*b*, along the outer perimeters. Other support beams 218 extend along the inner straight sides of each part. The support beams together defining spaces with the inner surfaces of the first and second parts that together define a storage volume when the furniture is in its folded condition, where additional parts of the furniture such as legs, cloth coverings or other accessories for the furniture can be stored. All beams are fixed to the bottom surface of the parts 212*a* and 212*b* by glue and/or screws, or by any other means known in the furniture art.

To increase the inner storage space inside the folded headboard, the upper and side perimeters of the headboard parts may also include deeper support skirt beams 217 and 219. This also increases the apparent thickness of the headboard without adding weight to the overall structure.

Figure 15:
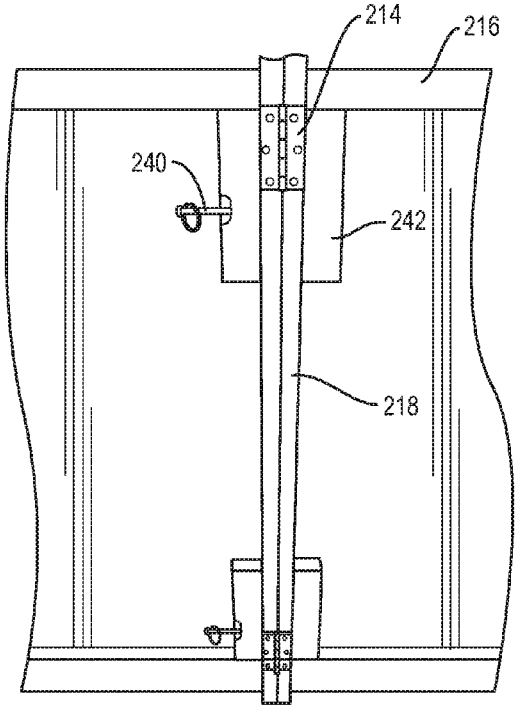
FIG. 15 is a partial perspective view of the bottom of the furniture piece of FIG. 14 to illustrate the locking pins and their use for holding the headboard in its use condition.
Figure 16:
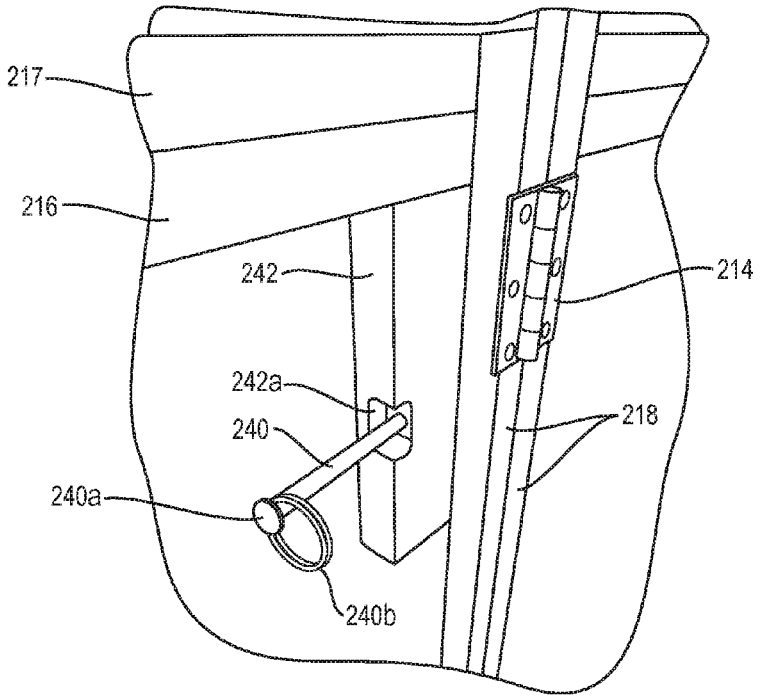
FIG. 16 is an enlarged detail of the bottom of the furniture piece of FIG. 14 to illustrate a locking pin as it is being inserted to lock the planar member flat.

To keep the headboard from folding when in its use condition, locking pins 240 removably extend into sets of aligned locking bores in beams 218 when the planar headboard body 212 is in the flat or use condition, for locking it flat. To further secure this anti-folding effect, pins 240 are strong metal, e.g. brass or steel, and extra pin-receiving blocks 242 are fixed, e.g. by glue and/or screws, to the sides of beams 218, 218 and to the bottom surface of the adjacent part 212*a* or 212*b*. The locking bores for the pins 240 extend through these blocks as well. Each locking pin is long enough to extend the full length of each aligned locking bore, and importantly to fully span the junction between the beams 218 for positively preventing the planar member hinges 214, 214, from folding. To keep the pins from being overly long and to partly enclose the pin head 240*a*, notched 242*a* are cut into the inner surface of a block 242 on at least one side of the beams 218 as shown in FIGS. 15 and 16.

To further facilitate assembly and disassembly of any embodiment of the furniture, each locking pin, e.g. pin 240, also has a ring 240*b* extending in a cross bore in the pin, near or at the pin head 240*a*. This ring can be hooked by a finger or otherwise tightly held to help extract a locking pin that has become too firmly seated in its locking bore, for example. Such rings can be use in the locking pins of the other embodiments of the invention as well.

As shown in FIG. 14, a spacer block 270 of wood, rubber or other material, is connected to an inside surface of each leg 230 for engaging the inner surface of a respective one of the first and second parts 212*a* and 212*b*, for holding the legs parallel to the inside surface when the legs are pivoted into storage positions between the parts in the folded compact condition of the furniture piece. To this end each spacer block 270 has the same thickness as the support beams 216 and 218 and the legs 230 each have the same thickness as well. The space blocks keep leg hinges 250 for the legs from being damaged by over pivoting the legs in their folded positions and also reduces noise but keeping the folded legs from rattling during transport of the folded headboard 210.

Figure 17:
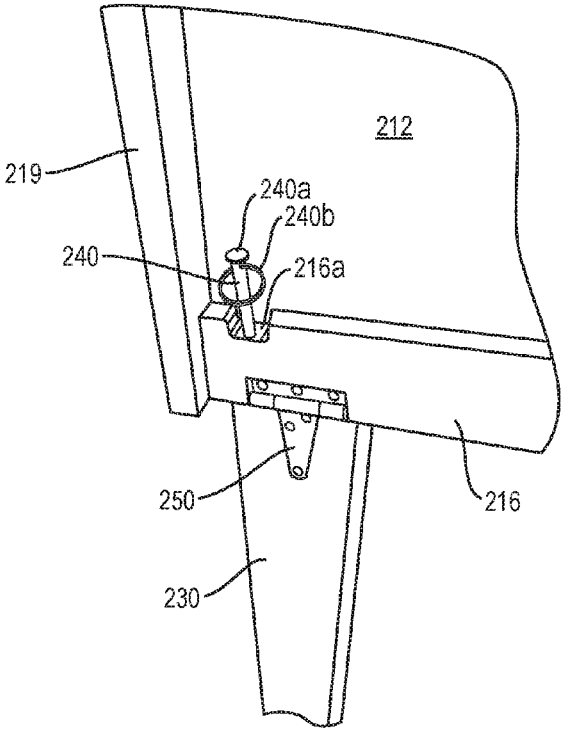
FIG. 17 is an enlarged detail of the bottom of the furniture piece of FIG. 14 to illustrate a locking pin as it is being inserted to lock a hinged leg in place.
Figure 18:
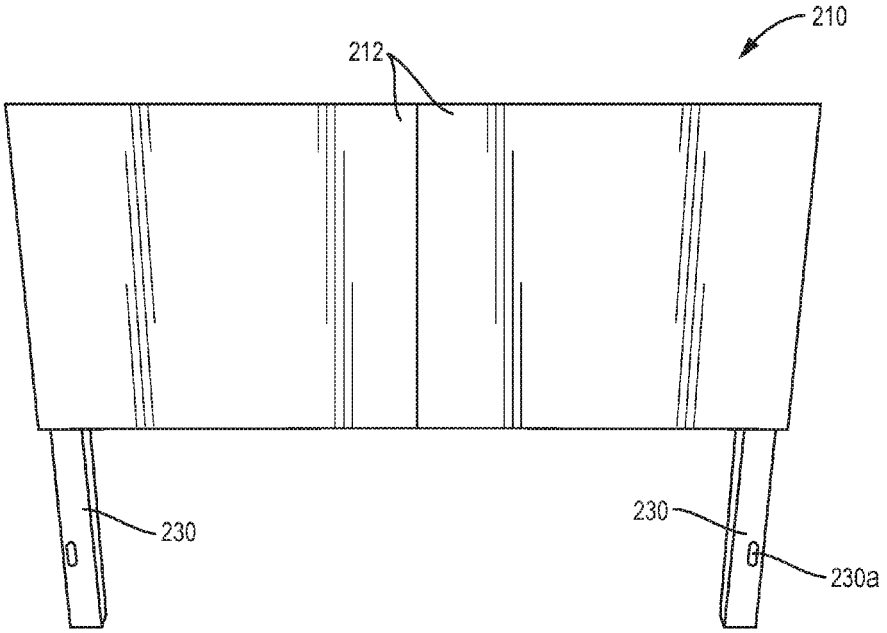
FIG. 18 is a front elevational view of the furniture piece of FIG. 14 in the use condition, ready to be connected to a bed frame.

As shown in FIG. 17, to fully unfold the headboard 210 to its use condition, each of two legs 230 are unfolded from the space between the parts 212*a* and 212*b*, down to extend below the parts. To this end, each leg 230 is hinged by a leg hinge 250 to the lower perimeter beam 216. To the deeper skirt beam 219 at each side of the headboard 210 also provides extra volume in the folded headboard to accommodate the folded legs in the space between the parts 212*a* and 212*b* when they are folded into the folded condition.

With the legs 230 folded down, locking pins 240 are extended into aligned locking bores in the beam 216 and in the end of the leg 230, to keep the leg from folding. A notch 216*a* can be provided in the inner side of the beam 216 to accommodate the pin head and ring as with the pins used to keep the headboard parts 212*a* and 212*b*, flat.

The embodiment of FIGS. 19 to 22 is similar in most respects to the embodiment of FIGS. 13 to 18 except that the legs are screws to the lower beams 316 of the headboard parts 312*a* and 312*b*, with the added aid of filler blocks 316*a* fixed above the beams 316.

In this embodiment the perimeter beams 316 and hinged together side beams 318 may be of the same thickness as the legs 330 since a thinner interior volume of the folded headboard is needed to accommodate the legs 330 and any accessory like a cloth slipcover 360, in the furniture in its folded condition. No thicker skirt beams are need in this embodiment and a slimmer headboard in its use condition results. In the alternative, thicker skirt beams may be provided around the sides and top of parts 312*a* and 312*b*, to create the appearance of a thicker more massive headboard that can be covered by a suitable slipcover, but without the added weight.

Figure 19:
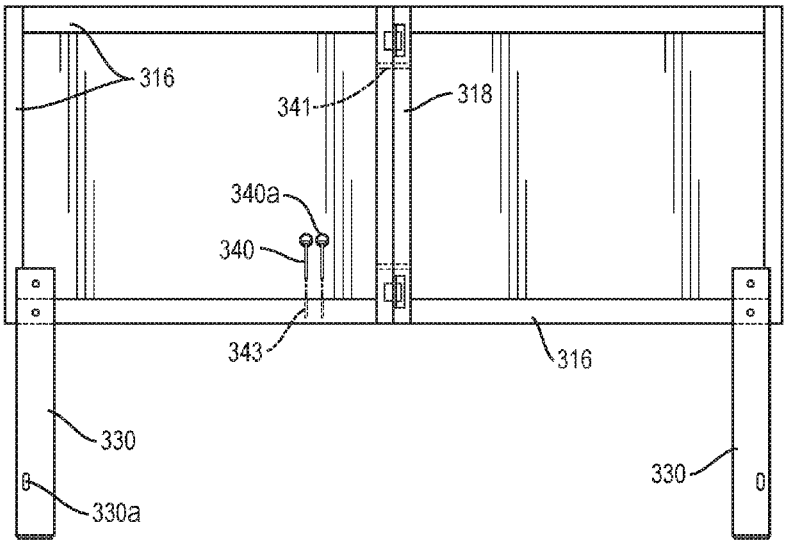
FIG. 19 is a rear elevational view of a second embodiment of a headboard according to the invention with screw-on legs.
Figure 20:
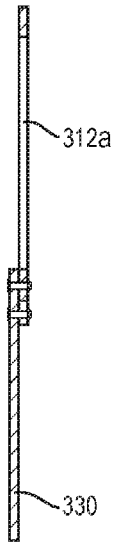
FIG. 20 is a side elevational view of the headboard of FIG. 19.
Figure 21:
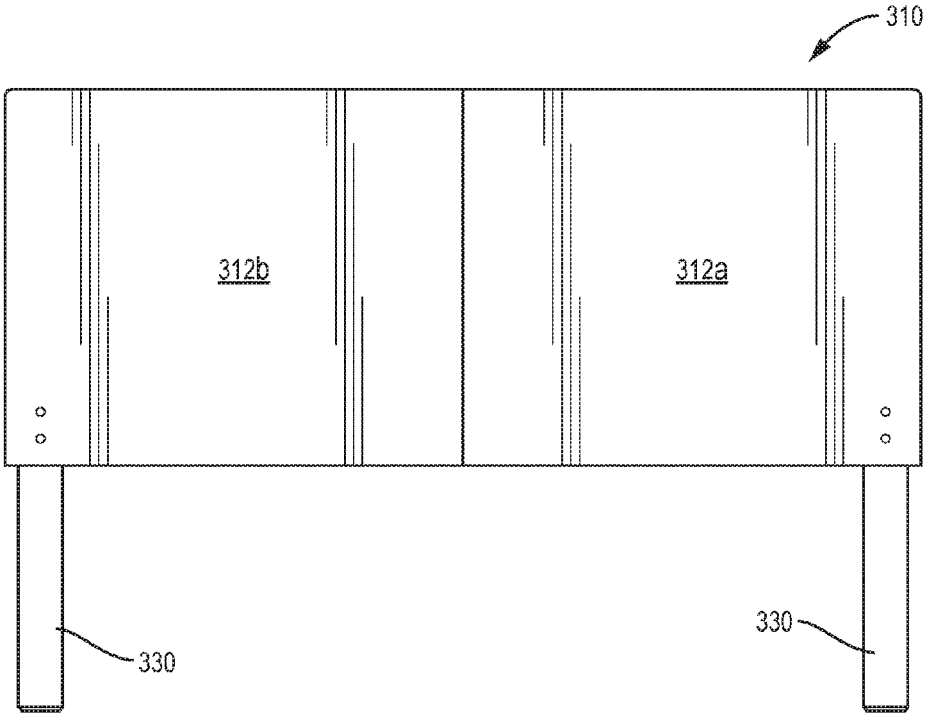
FIG. 21 is a front elevational view of the headboard of FIG. 19.
Figure 22:
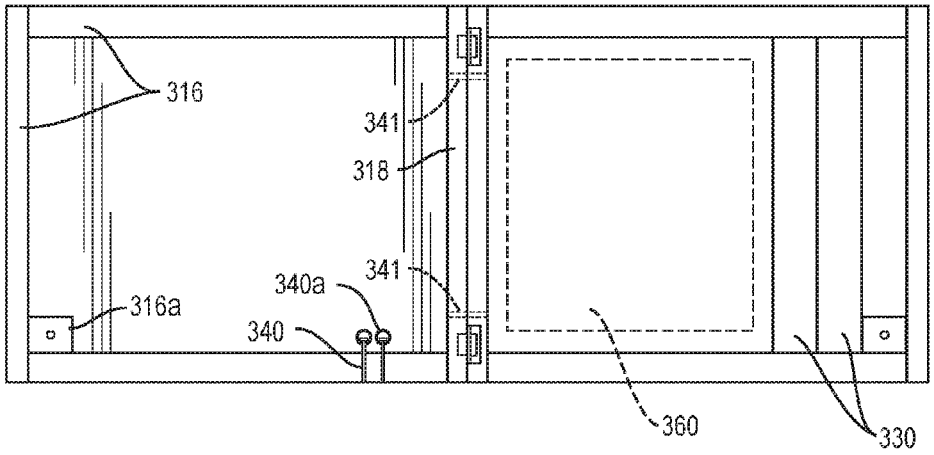
FIG. 22 is a rear elevational view of the headboard of FIG. 19 with the legs disconnected and stored in the volume between the first and second hinged parts of the planar member along with a folded slip cover for covering the headboard in its use condition, and before the hinged parts are folded for storage or transport.

Locking pins 340 with rings 340*a* that keep the parts 312*a* and 312*b* flat in the use condition of FIGS. 19 and 21 by extending through aligned locking bores shown schematically at 341, 341 in FIG. 19, can be stored in blind storage bores 343, 343 extending from inner surfaces of one of the lower support beams 316, into this support beam.

In the headboard embodiments of FIGS. 13 to 22, the legs 230 and 330 include apertures 230*a* and 330*a* that are used to receive bolts to connect the headboards in their use condition, to the head end of conventional bed frames to secure each headboard to a bed frame in a known manner.

While specific embodiments of the invention have been shown and described in detail to illustrate the application of the principles of the invention, it will be understood that the invention may be embodied otherwise without departing from such principles.

What is claimed is:

1. A folding furniture piece comprising:

a planar member having a first part with an outer perimeter and an inner straight side and a second part with an outer perimeter and an inner straight side, the inner straight sides being adjacent each other and being hingedly connected to each other, the planar member having a folded compact condition with inner surfaces of the first and second parts overlapping each other, and an unfolded use condition with outer surfaces of the first and second parts lying in a common plane;

a plurality of support beams extending on the inner surfaces of the first and second parts and along the outer perimeters and inner straight sides of each part, the support beams defining spaces with the inner surfaces of the first and second parts, each of the support beams along the sides of the first and second parts having at least one locking bore extending substantially transversely to a respective straight side, the locking bores being coaxially aligned with each other when the planar member is in the use condition;

a locking pin removably extending into each aligned locking bore when the planar member is in the use condition for locking the planar member in the use condition; and a plurality of legs movably connected to the planar member for supporting the planar member above a floor in the use condition;

the outer surfaces of the first and second parts of the planar member in the use condition forming a headboard, there being two of the legs each pivotally mounted to a lower support beam at a lower part of the outer perimeter, a pair of spaced additional locking bores each extending through the lower support beam and into a respective leg, and a locking pin extending into each additional locking bore and leg for locking each leg is a use condition extending below the lower support beam.

2. The folding furniture piece of claim 1 including a notch in a side surface of the support beam containing at least one of the locking bores, at an entry end of the at least one locking bore, the locking pin for extending into the at least one locking bore having a head at least partly enclosed in the notch.

3. The folding furniture piece of claim 1 including a ring extending through each locking pin near a head end thereof for aiding insertion and extraction of the locking pins into and out of a respective locking bore.

4. The folding furniture piece of claim 1 including a fabric member stored between the first and second parts in the folded condition of the furniture piece.

5. A folding furniture piece comprising:

a planar member having a first part with an outer perimeter and an inner straight side and a second part with an outer perimeter and an inner straight side, the inner straight sides being adjacent each other and being hingedly connected to each other, the planar member having a folded compact condition with inner surfaces of the first and second parts overlapping each other, and an unfolded use condition with outer surfaces of the first and second parts lying in a common plane;

a plurality of support beams extending on the inner surfaces of the first and second parts and along the outer perimeters and inner straight sides of each part, the support beams defining spaces with the inner surfaces of the first and second parts, each of the support beams along the sides of the first and second parts having at least one locking bore extending substantially transversely to a respective straight side, the locking bores being coaxially aligned with each other when the planar member is in the use condition;

a locking pin removably extending into each aligned locking bore when the planar member is in the use condition for locking the planar member in the use condition; and a plurality of legs movably connected to the planar member for supporting the planar member above a floor in the use condition;

the outer surfaces of the first and second parts of the planar member in the use condition forming a headboard, there being two of the legs each pivotally mounted to a lower support beam at a lower part of the outer perimeter, a pair of spaced additional locking bores each extending through the lower support beam and into a respective leg, and a locking pin extending into each additional locking bore and leg for locking each leg is a use condition extending below the lower support beam, and a spacer block connected to an inside surface of each leg for engaging the inner surface of a respective one of the first and second parts for holding the legs parallel to the inside surface when the legs are pivoted into storage positions between the parts in folded compact condition of the furniture piece.

6. The folding furniture piece of claim 5 including a notch in a side surface of the support beam containing at least one of the locking bores, at an entry end of the at least one locking bore, the locking pin for extending into the at least one locking bore having a head at least partly enclosed in the notch.

7. The folding furniture piece of claim 5 including a fabric slipcover stored between the first and second parts in the folded condition of the furniture piece for use to cover the headboard in the use condition of the furniture piece.

8. The folding furniture piece of claim 5 including a ring extending through each locking pin near a head end thereof for aiding insertion and extraction of the locking pin into and out of a respective locking bore.

* * * * *